United States Patent [19]

Mitzutani et al.

[11] Patent Number: 5,074,692

[45] Date of Patent: Dec. 24, 1991

[54] SERIAL PRINTER AND A METHOD OF ASSEMBLING THE SAME

[75] Inventors: Minoru Mitzutani; Shyoichi Watanabe, both of Tokyo; Toshiaki Saito, Fukushima, all of Japan

[73] Assignee: Oki Electric Industry Co., Ltd., Tokyo, Japan

[21] Appl. No.: 433,215

[22] Filed: Nov. 7, 1989

[30] Foreign Application Priority Data

Nov. 8, 1988 [JP] Japan ..... 63-144996

[51] Int. Cl.[5] ..... B41J 29/38

[52] U.S. Cl. ..... 400/692; 400/691

[58] Field of Search ..... 400/692, 691, 719; 361/413, 403; 439/55, 62

[56] References Cited

U.S. PATENT DOCUMENTS

| | | | |
|---|---|---|---|
| 4,193,108 | 3/1980 | Romano | 361/413 |
| 4,477,862 | 10/1984 | Gozales | 361/413 |
| 4,495,548 | 1/1985 | Matsui | 361/413 |
| 4,591,284 | 5/1986 | Lim et al. | 400/719 |
| 4,595,794 | 6/1986 | Wasserman | 361/403 |
| 4,740,867 | 4/1988 | Roberts et al. | 361/413 |
| 4,806,036 | 2/1989 | Ward et al. | 400/691 |
| 4,881,839 | 11/1989 | Grimm | 400/692 |
| 4,899,254 | 2/1990 | Ferchau et al. | 361/413 |
| 4,974,121 | 11/1990 | Masuko et al. | 361/413 |

FOREIGN PATENT DOCUMENTS

| | | |
|---|---|---|
| 0271090 | 6/1988 | European Pat. Off. . |
| 2251110 | 6/1975 | France . |
| 61-104878 | 5/1986 | Japan . |
| 61-206682 | 9/1986 | Japan . |

OTHER PUBLICATIONS

IBM Technical Disclosure Bulletin, vol. 30, No. 3, 8/1987, Personal Computer Structure Designed for Robotized Manufacturability.

IBM Technical Disclosure Bulletin, vol. 25, No. 1, 6/1982, Electrical Connections in a Modularized Compact Copier.

European Search Report.

IBM Technical Disclosure Bulletin, vol. 18, No. 11, Apr. 1976, p. 3588.

*Primary Examiner*—Edgar S. Burr

*Assistant Examiner*—John S. Hilten

*Attorney, Agent, or Firm*—Specner & Frank

[57] ABSTRACT

A serial printer easy to assemble and capable of being assembled through an automatic assembling process. A control device is disposed near and along one of the opposite sides of a chassis and electrical components and distributed functional devices are disposed opposite to the control device. The electrical components and the distributed functional devices are connected electrically to the control device by connectors having elastic contact portions which maintain elastic contact with the signal terminals of the control device, the electrical components and the distributed functional devices (210, 220, 230).

6 Claims, 4 Drawing Sheets

SERIAL PRINTER AND A METHOD OF ASSEMBLING THE SAME

BACKGROUND OF THE INVENTION

The present invention relates to a serial printer having a print head mounted on a carriage and moved step by step in a horizontal direction for printing.

The distributed functional devices of the conventional serial printer including a control device, a power supply device, an operating device and an IC card connecting device are interconnected by a junction circuit device, and the electrical components including motors and sensors are connected to the distributed functional devices by leads.

However, the use of the junction circuit device for interconnecting the distributed functional devices is an impediment to the reduction of cost of the serial printer.

The troublesome work for connecting the electrical components to the distributed functional devices by leads requires much labor and adversely affects the efficiency of production of the serial printer. Furthermore, long leads require difficult wiring work and careful handling, and make the automatic assembling of the serial printer impossible.

SUMMARY OF THE INVENTION

It is an object of the present invention to provide a serial printer which is easy to assemble and handle, and capable of being assembled through an automatic assembling process.

It is another object of the present invention to provide an inexpensive serial printer which eliminates components which are essential to the conventional serial printer, such as a junction circuit device and the like.

In one aspect of the present invention, a serial printer comprises a control device disposed near and in parallel to one side of a chassis, electrical components disposed opposite to the control device, distributed functional devices disposed opposite to the control device, and connectors having elastic contact members electrically connecting the electrical components and the distributed functional devices to the control device.

Thus, according to the present invention, the electrical components and the distributed functional devices are connected electrically to the control device without using any leads and junction circuit devices, so that the serial printer is easy to assemble and handle.

The above and other objects, features and advantages of the present invention will become more apparent from the following description taken in conjunction with the accompanying drawings.

DETAILED DESCRIPTION OF A PREFERRED EMBODIMENT

Figure 1:
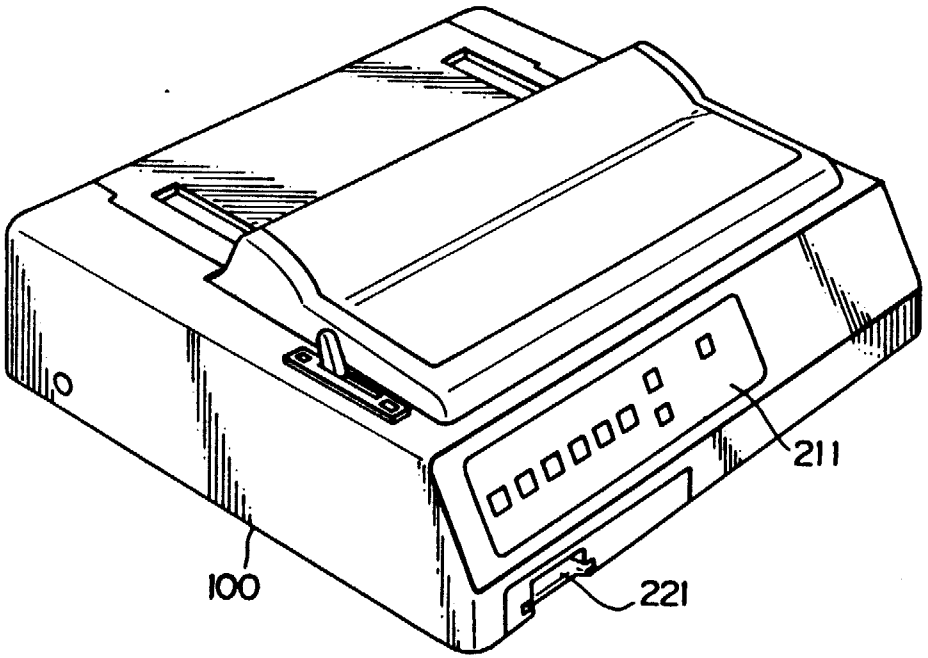
FIG. 1 is a perspective view of a serial printer embodying the present invention.
Figure 2:
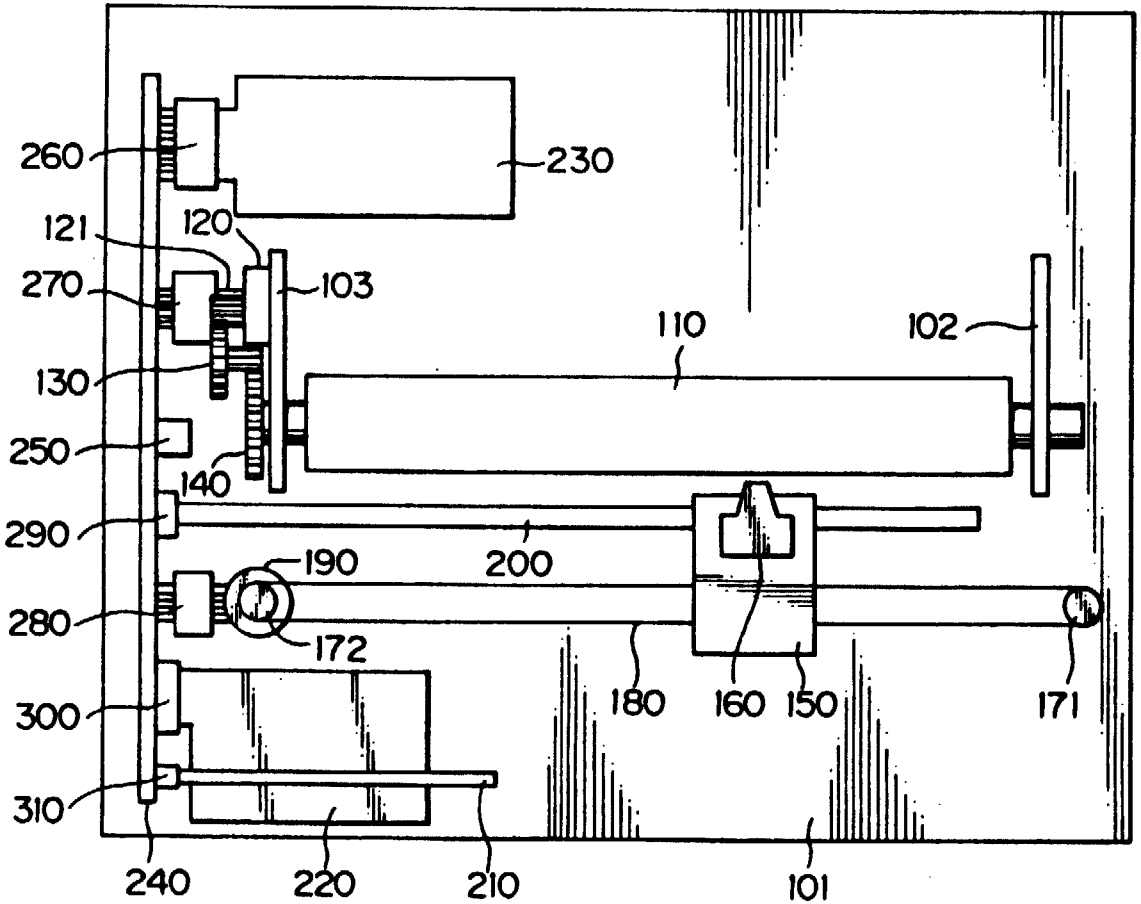
FIG. 2 is a plan view showing the internal structure of the serial printer of FIG. 1.

FIG. 1 is a perspective view of a serial printer in a preferred embodiment according to the present invention, and FIG. 2 is a plan view showing the internal structure of the serial printer.

Referring to FIGS. 1 and 2, there are shown a printing unit 100, a chassis 101, side frames 102 and 103 fixed to the chassis 101, a platen 110 journaled on the side frames 102 and 103, a line-feed motor 120 fixed to the side frame 103, a driving pinion 121 fixed to the output shaft of the line-feed motor 120, an idle gear 130 engaging the driving pinion 121, a driven gear 140 engaging the idle gear 130 and fixed to the shaft of the platen 103. The line-feed motor 120 drives the platen 110 through the gear train including the driving pinion 121, the idle gear 130 and the driven gear 140 for rotation.

Best shown in FIG. 2 are a carriage 150, a print head 160 mounted on the carriage 150, a spacing motor 190, a belt pulley 171, a belt pulley 172 coaxially fixed to the output shaft of the spacing motor 190, and a timing belt 180 extended between the belt pulleys 171 and 172 and fastened to the carriage 150. The spacing motor 190 drives the carriage 150 mounted with the print head 160 through the belt pulley 172 and the timing belt 180 for lateral movement along the platen 110.

A flat cable 200 is connected to the printing coil, not shown, of the print head 160 to apply driving signals to the print head 160.

An operating device 210 and an IC card connecting device 220 are disposed in the front left-hand portion of the chassis 101. A power supply device 230 is disposed in the rear left-hand portion of the chassis 101. An operating panel 211 (see FIG. 1) associated with the operating device 210 is provided on the front wall of a case. An IC card receiving slot 221 is formed in the front wall of the case to insert an IC card in the operating device 220. The operating device 210, the IC card connecting device 220 and the power supply device 230 are distributed functional devices.

Referring to FIG. 2, a control device 240 is disposed within the case in parallel to the left-hand end of the chassis 101. The electrical components including the line-feed motor 120 and the spacing motor 190, and the distributed functional devices are connected electrically to the control device 240.

The control device 240, the distributed functional devices and all the electrical components are fixed to the chassis 101.

Although the control device 240, the distributed functional devices and the electrical components are disposed in the left-hand section of the chassis 101 in this embodiment, those components may be disposed in the right-hand section of the chassis 104.

A paper end sensor 250 for detecting the trailing end of a recording paper is soldered to the control device 240. The paper end sensor 250 is a Hall-effect element, an optical sensor or a reed switch.

The power supply device 230, the line-feed motor 120, the spacing motor 190, the flat cable 200, the IC card connecting device 220 and the operating device 210 are connected to the control device 240 by connectors 260, 270, 280, 290, 300 and 310 respectively.

The connectors 260, 270 and 280 are substantially the same in structure, and the connectors 290, 300 and 310 are substantially the same in structure, and hence only the structures of the connectors 270 and 300 will be described as examples.

Figure 5:
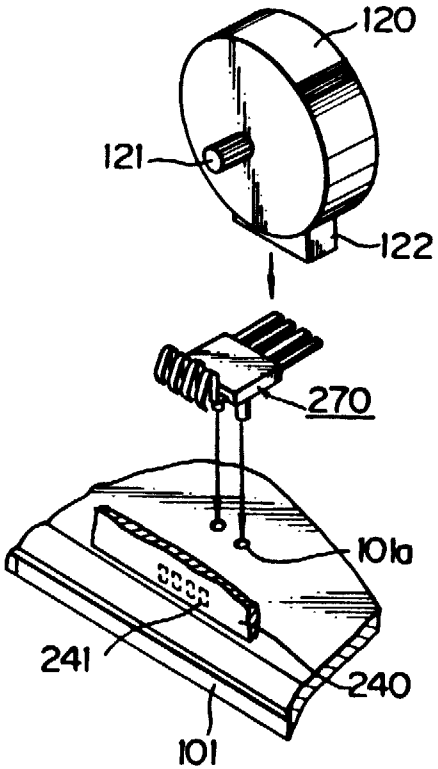
FIG. 5 is a perspective view for assistance in explaining a manner of assembling the essential portion shown in FIG. 3.
Figure 3:
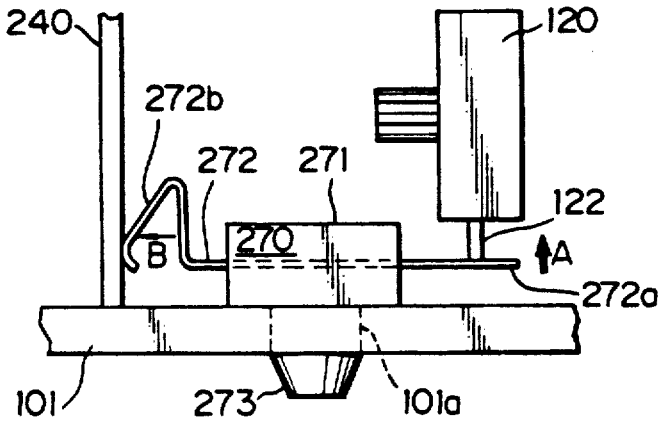
FIG. 3 is a side elevation of an essential portion of the serial printer of FIG. 1.
Figure 4:
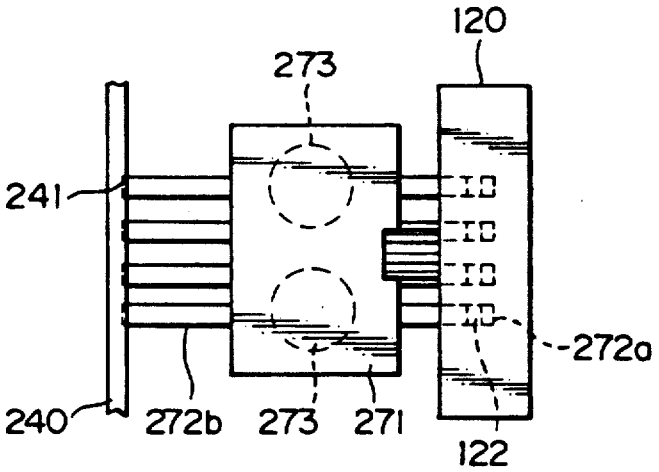
FIG. 4 is a plan view of the essential portion shown in FIG. 3.

FIG. 3 is a side elevation showing the structure of the connector 270, FIG. 4 is a plan view of the connector 270, and FIG. 5 is a perspective view for assistance in explaining a manner of assembling the connector 270.

The connector 270 comprises a base 271 formed of a nonconductive material, elastic connecting members 272 formed of spring plates, and pins 273 projecting from the lower surface of the base 271. The base 271, the connecting members 272 and the pins 273 are assembled in an integral unit by molding.

The connector 270 can be fastened to the chassis 101 simply by pressing the pins 273 into holes 101*a* formed in the chassis 101. When the connector 270, the line-feed motor 120 and the control device 240 are set in place, the contact portions 272*a* of the connecting members 272 extending on one side of the connector 270 tend to press themselves against the signal terminals 122 of the line-feed motor 120 as indicated by an arrow A, and the contact portions 272*b* of the connecting members 272 extending on the other side of the connector 270 tend to press themselves against the signal terminals 241 of the control device 240 as indicated by an arrow B.

Alternatively, the connector 270 may be formed integrally with the chassis 101 by molding.

Figure 6:
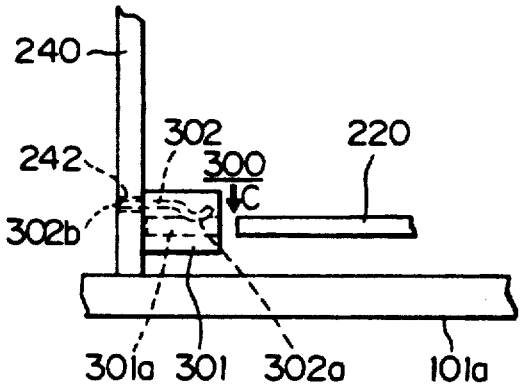
FIG. 6 is a side elevation of another essential portion of the serial printer of FIG. 1.
Figure 7:
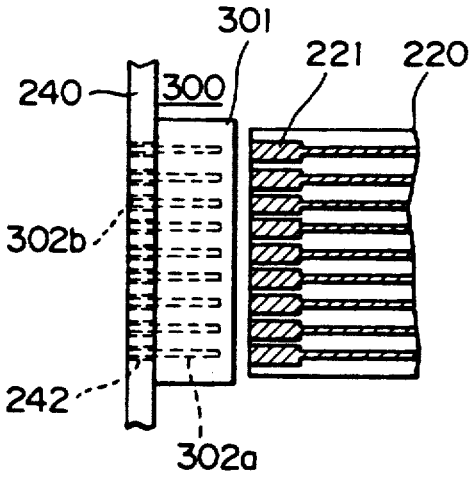
FIG. 7 is a plan view of the essential portion shown in FIG. 6.

Referring to FIG. 6 and 7, the connector 300 comprises a base 301 formed of a nonconductive material and provided with a socket 301*a* for receiving the IC card connecting device 220, and elastic, conductive connecting pins 302. The elastic contact portions 302*a* of the contact pins 302 extending on one side of the base 301 project into the socket 301*a*, and the projecting contact portions 302*b* of the contact pins 302 extending on the other side of the base 301 project from the base 301. The connector 300 is formed in an integral member by molding.

In attaching the connector 300 to the control device 240, the projecting contact portions 302*b* are inserted in connecting holes 242 formed in the control device 240 and are soldered to conductors provided in the connecting holes 242.

The contact portions 302*a* of the connecting pins 302 are bent elastically in a direction indicated by an arrow C, so that the signal terminals 221 of the IC card connecting device 220 are in firm contact with the connecting pins 302 when the IC card connecting device 330 is inserted in the socket 301*a*.

Procedure for assembling the serial printer thus constructed will be described hereinafter.

First, the connectors 260, 270 and 280 are fastened to the chassis 101 in the aforesaid manner.

Then, the power supply device 230, the line-feed motor 120 and the spacing motor 190 are fastened to the chassis with their connecting terminals (for example, the signal terminals 122 of the line-feed motor 120) pressed against the corresponding elastic contact portions (for example, the elastic contact portions 272*a* of the connector 270) of the contact members of the connectors 260, 270 and 280 respectively.

After soldering the connectors 290, 300 and 310, and the paper end sensor 250 to the control device 240, the control device 240 is fixed to the chassis 101 at the predetermined position with the signal terminals 241 thereof pressed against the corresponding elastic contact portions (for example, the elastic contact portions 272*b* of the connector 270) of the connecting members of the connectors 260, 270 and 280. Thus, the power supply device 230, the line-feed motor 120 and the spacing motor 190 are connected electrically to the control device 240.

Subsequently, the flat cable 200, the operating device 210 and the IC card connecting device 220 are inserted in the sockets of the connectors 290, 300 and 210 respectively with their signal terminals pressed against the elastic contact pins of the corresponding connectors. Thus, the flat cable 200, the operating device 210 and the IC card connecting device 220 are connected electrically to the control device 220. Then, the operating device 210 and the IC card connecting device 220 are fastened to the chassis 101.

Although this embodiment employs the connectors fixed to the control device 240 to connect the flat cable 200, the operating device 210 and the IC card connecting device 220 to the control device 240, and the connectors fixed to the chassis 101 to connect the power supply device 230, the line-feed motor 120 and the spacing motor 190 to the control device 240, means for connecting those components to the control device 240 need not be limited thereto; the flat cable 200, the operating device 210 and the IC card connecting device 220 may be connected by connectors fixed to the chassis 101, and the power supply device 230, the line-feed motor 120 and the spacing motor 190 may be connected to the control device 240 by connectors fixed to the control device 240, or the flat cable 200, the operating device 210, the IC card connecting device 220, the power supply device 230, the line-feed motor 120 and the spacing motor 190 may be connected to the control device 240 by either the connectors fixed to the control device 240 or the connectors fixed to the chassis 101.

Furthermore, although the control device 240 is disposed near and in parallel horizontally to one of the shorter sides of the chassis 101 in this embodiment, the control device 240 may be disposed longitudinally near one of the shorter sides of the chassis 101 and the distributed functional devices and the electrical components may be arranged accordingly.

Although the invention has been described in its preferred form with a certain degree of particularity, it is to be understood that many variations and changes are possible in the invention without departing from the scope thereof.

We claim:

1. In a serial printer having a platen mounted on a drive shaft and disposed in a horizontal position, a carriage, and a print head mounted on the carriage and moved along the platen for printing, the combination comprising:

a chassis supporting the platen and the carriage;

two side frames mounted on the chassis and rotatably supporting therebetween the platen;

a drive motor attached to one of the two side frames for driving the drive shaft of the platen;

an elongated control device, having a side face and signal terminals along its length, the control device being disposed outside of said one side frame attached to the drive motor and disposed in a direction perpendicular to the drive shaft of the platen and perpendicular to said chassis;

electrical components, including the drive motor, having signal terminals, the electrical components being disposed with their signal terminals respectively opposite to corresponding signal terminals of said control device;

distributed functional devices, including a power supply device, an operating device and an IC card connecting device, each provided with signal terminals and disposed perpendicularly to the side face of said control device, the distributed functional devices each being disposed with their signal terminals respectively opposite to corresponding signal terminals of the control device; and a plurality of connectors each being disposed between said control device and a respective one of said distributed functional devices and said electrical components for establishing electrical connections between said control device and said distributed functional devices and between said control device and said electrical components, each connector including elastic contact members in direct contact with the signal terminals of said control device at one side of said connector and in direct contact with the signal terminals of one of said distributed functional devices and said electrical components at another said of said connector.

2. A serial printer according to claim 1 wherein at least one of the connectors comprises:

a base formed on a non-conductive material;

conductive connecting members supported by the base and being in the form of spring plates forming the elastic contact members; and pins projecting from a lower surface of the base for mounting the base in said chassis;

wherein said base, connecting members and pins are assembled in an integral unit by molding, said at least one connector connecting said control device with one of the electrical components or said distributed functional devices electrically through said elastic contact members.

3. A serial printer according to claim 2, wherein the spring plates have opposite ends each of which form an elastic contact member exposed outside of said base.

4. A serial printer according to claim 1, wherein at least one of the connectors comprises:

a base formed of nonconductive material and including an insert slot for inserting a distributed functional device; and conductive connecting members supported by the base with each connecting member being in the form of a spring plate having opposite ends with at least one of the ends presenting an elastic contact member exposed inside of said slot and with the other end projecting from said base;

wherein the base, connecting members and insert slot are assembled in an integral unit by molding.

5. A method of assembling a serial printer having an elongated platen disposed in a horizontal position, a carriage, a print head mounted on the carriage and moved along the platen for printing and a chassis supporting the platen and the carriage, said method comprising:

providing electrical connectors including electrical connecting members having opposite ends each presenting electrical contacts, and pins for attaching the electrical connectors to the chassis, with the electrical connectors being formed by molding to create an integral unit;

disposing an elongated control device, having signal terminals along its length, to one side of the longitudinal extent of the elongated platen and in a direction perpendicular to the longitudinal extent of the platen and perpendicular to the chassis;

fixing the connectors to the chassis at positions near the one side of the longitudinal extent of the elongated platen by pressing the pins into holes provided in the chassis so that the electrical contacts at one end of the electrical connector members are in direct contact with corresponding signal terminals of the control device; and disposing electrical components and distributed functional devices, each having electrical terminals, so that the electrical terminals of the electrical components and distributed functional devices are in direct contact with the electrical contacts at the other end of the electrical connecting members.

6. A method of assembling a serial printer according to claim 5, wherein said step of providing electrical connectors includes providing each electrical connector with a base and providing the pins on lower surfaces of the bases.

* * * * *

UNITED STATES PATENT AND TRADEMARK OFFICE

CERTIFICATE OF CORRECTION

PATENT NO. : 5,074,692

DATED : December 24th, 1991

INVENTOR(S) : Minoru MIZUTANI et al.

It is certified that error appears in the above-identified patent and that said Letters Patent is hereby corrected as shown below:

On the Title page, item [75], change "Mitzutani" to --Mizutani--.

Signed and Sealed this

Eighth Day of June, 1993

*Attest:*

Michael K. Kirk

MICHAEL K. KIRK

*Attesting Officer*

*Acting Commissioner of Patents and Trademarks*